United States Patent [19]

Siria et al.

[11] Patent Number: 5,062,487

[45] Date of Patent: Nov. 5, 1991

[54] HAND-PORTABLE FIRE FIGHTING POSITIVE PRESSURE WATER MISTING AND VENTILATION BLOWER

[75] Inventors: Darrell L. Siria, N. 12023 Hemlock Ct., Spokane, Wash. 99218; Lorran Sommerfeld, Spokane; Daniel G. Raczykowski, Airway, both of Wash.

[73] Assignee: Darrel Lee Siria, Spokane, Wash.

[21] Appl. No.: 535,376

[22] Filed: Jun. 7, 1990

[51] Int. Cl.[5] ..... A62C 39/00

[52] U.S. Cl. ..... 169/91; 169/70; 169/52

[58] Field of Search ..... 169/54, 52, 14, 15, 169/91, 70; 239/14.2, 2.2, 398; 416/63

[56] References Cited

U.S. PATENT DOCUMENTS

| | | | |
|---|---|---|---|
| 2,884,075 | 4/1959 | Poon | 169/52 X |
| 3,428,131 | 2/1969 | Winslow | 239/251 X |
| 3,979,061 | 9/1976 | Kircher | 239/14.2 X |
| 4,427,074 | 1/1984 | Wollin | 169/70 X |
| 4,682,729 | 7/1987 | Doman et al. | 239/14.2 X |
| 4,906,164 | 3/1990 | Jackmann et al. | 416/63 |
| 4,907,654 | 3/1990 | Eberhardt | 169/70 |
| 4,976,319 | 12/1990 | Eberhardt et al. | 169/91 |

OTHER PUBLICATIONS

Advertisement or product announcement: "Tempest Certified Performance for Belt-Driven Power Blower", 9/88.

Advertisement or product announcement: "Gasoline and Electrical Powered Smokemovers and Accessories", 7/84.

Advertisement or product announcement: "New Product Update-LifeJack's the PPV", Date Unknown. .

Advertisement or product announcement: "New Super Vac Gas Positive Pressure Smoke Ventilators", Date Unknown.

Advertisement or product announcement: "Gasoline Powered Smoke Fans", Date Unknown.

Advertisement: "Typhoon", Date Unknown.

*Primary Examiner*—Joseph F. Peters, Jr.
*Assistant Examiner*—Christopher P. Ellis
*Attorney, Agent, or Firm*—Wells, St. John & Roberts

[57] ABSTRACT

The drawings and description describe a hand-portable fire fighting, positive pressure blower with water misting provisions 10 for cooling and producing positive pressure within a smoke filled space and to remove the smoke, heat and carbon dioxide from the area to facilitate extinguishment of the fire and subsequent overhauling. The blower 10 includes a portable support frame 12. An internal combustion engine 13 is mounted thereon with a drive shaft mounted propeller 18 for generating an airstream to be directed into the smoke filled space. Misting nozzles are mountable to the frame and are positioned thereon to direct a spray mist into the airstream from positions radially outward of the airstream. The nozzles are positioned in relation to the direction of propeller rotation so the spray mist will be carried over a maximum distance. The water spray mist substantially cools the airstream which then absorbs much of the heat in the area. The mist also travels with the airstream to help extinguish the fire and to carry products of combustion away. The area is thus left cooler and with greater visibility to enable fire fighters to attack the fire.

25 Claims, 6 Drawing Sheets

111
115
97
20
Q1
18
106
105
104
109
Q2
98
111
115

HAND-PORTABLE FIRE FIGHTING POSITIVE PRESSURE WATER MISTING AND VENTILATION BLOWER

TECHNICAL FIELD

This invention relates to fire fighting equipment and more particularly to hand portable fire fighting, positive pressure water misting and ventilation blower classified in Class 169, subclass 99.

BACKGROUND OF THE INVENTION

It has been found that positive pressure ventilation of a structure sustaining an internal fire has many advantages. The use of positive pressure ventilation techniques usually results in removing the smoke in a fraction of the time previously required. The faster evacuation of smoke reduces smoke damage. Most importantly the rapid removal of the smoke and cooling of the area dramatically increases fire fighting safety. The firemen have considerably greater visibility to see and comfort within the burning structure. They are then more able to rapidly locate the hot spots without having to crawl on the floor. Also, the speedy removal of smoke and the replacement with cool moist air allows breathing apparatus to be removed sooner. Overall physical stress of fire fighters is reduced with less stress related injuries. This all results in greater fire fighting productivity.

To be able to obtain the above advantages a lightweight, hand portable positive pressure blower is required that can be easily maneuvered into position in front of an opening to a burning structure. Such a blower is disclosed in U.S. Pat. No. 4,906,164. The blower disclosed therein has substantial benefits in producing a positive ventilating pressure for fire fighting. The disclosed blower is easily transported and stored on a fire fighting vehicle.

It has been found that the addition of a water mist to the airstream of a positive pressure blower obtains benefits not realized with dry airstreams. The addition of water to the airstream has the effect of drastically cooling the airstream. This has the very noticeable benefit of increasing the comfort and safety of the fire fighters and victims in the airstream. Further, the moisture in the air has the potential of extinguishing fire without causing water damage. Still further, small droplets of water in the moving airstream collect particles of combustion and smoke, carrying both away from the heat source, increasing visibility and breathability of air within the structure.

A misting fire ventilation blower is commercially available through the Hale Fire Pump Company of Conshohocken, Pa. The device is sold under the Trademark, "TYPHOON". It is a water turbine driven positive pressure ventilation system with an on-demand water mist injector. The injector nozzles are placed on the blower at locations directly upstream of the blower blades. The injected water must pass through the rotating blades before being driven into the discharged airstream. Many of the droplets strike the several blades and are thrown by centrifugal force onto the surrounding shroud, only to drop off onto the ground surface. The water droplets that do not collect on the blower shroud move by centrifugal force of currents in the airstream to the outward perimeter of the airstream, where many gather into large droplets and precipitate out of the airstream before reaching the fire. The apparatus therefore calls for an amount of water (up to 8 gallons per minute) that is excessive. Still, the water that does remain airborne has the desired effect of cooling the airstream and reducing ambient temperature.

A need remains to obtain a positive pressure ventilation blower and water misting system that will minimize water usage while maximizing the water content of the ventilator airstream and likewise maximizing the attendant benefits to the firefighters, victims, and the involved structure.

One of the objects and advantages of the present invention is to provide a compact, hand portable positive pressure blower that can be easily stored on a fire fighting vehicle and that has the capability of producing an airstream with an optimum water content in the form of mist and vapor that will facilitate maximum cooling of ambient air, and to carry the moisture laden air fully into and through a desired area involved in a fire.

A further object is to provide such a ventilator that will minimize the amount of water required for such air cooling and thereby minimize water damage to adjacent structures.

A still further object is to provide such a ventilator that will occupy only a single water supply hose at minimal operating pressure.

A further object of this invention is to provide such a blower which does not require the presence of an attendant during operation.

These and other objects and advantages will become apparent upon reading the following description of a preferred embodiment of this invention.

BRIEF DESCRIPTION OF THE DRAWINGS

The preferred embodiment of the invention is illustrated in the accompanying drawings, in which:

FIG. 4 is a fragmentary top plan view of the blower emphasizing features of the present water misting system, the engine not being shown for clarity;

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
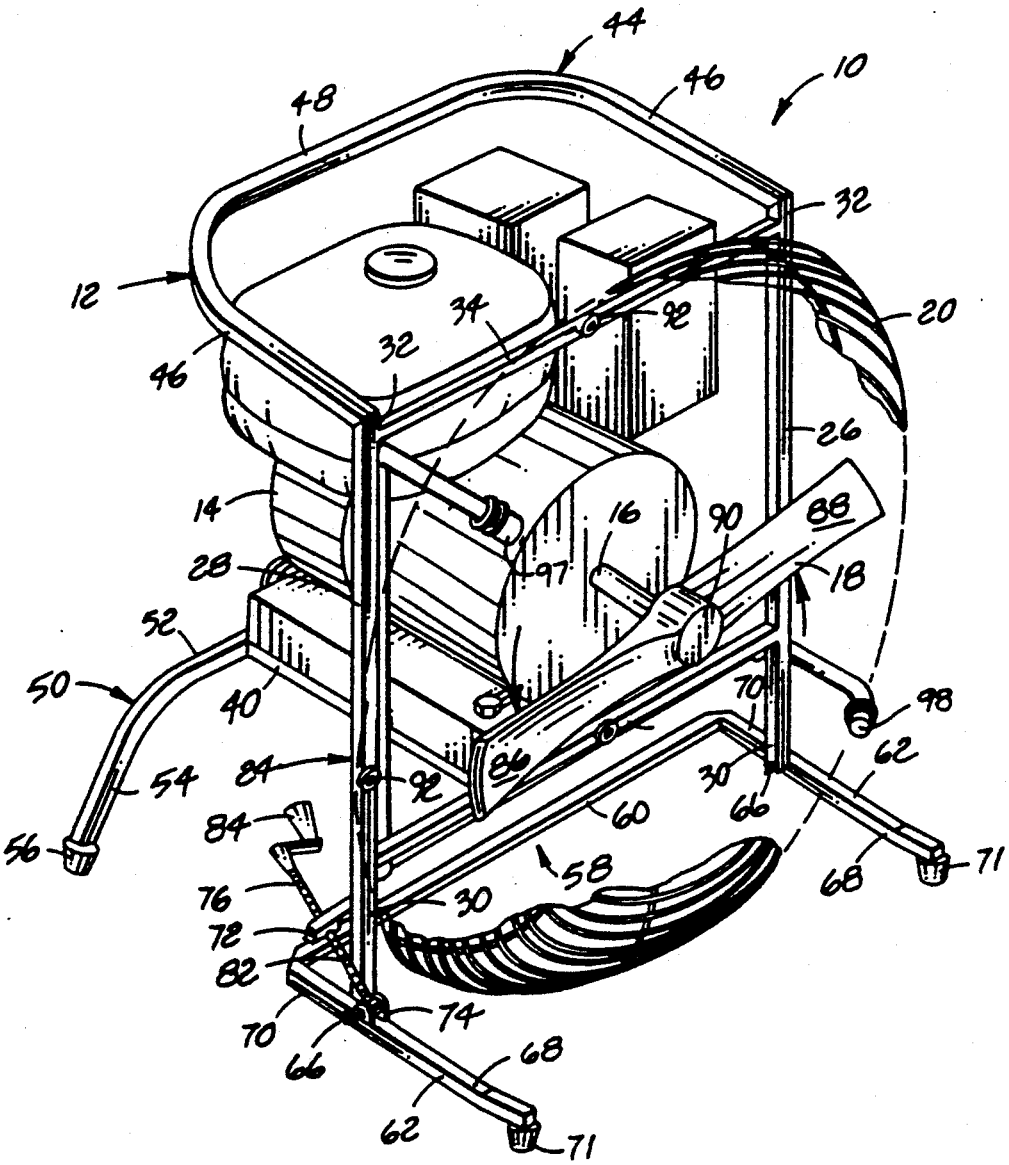
FIG. 1 is a perspective view of a hand-portable fire fighting, positive pressure ventilation and water misting blower.
Figure 2:
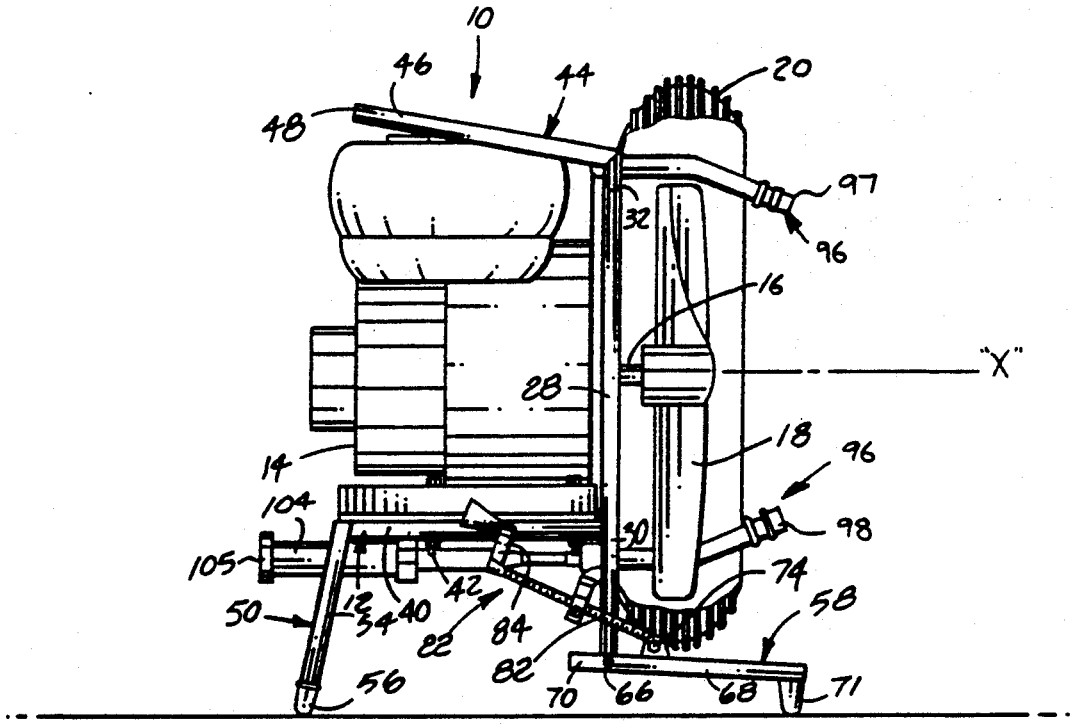
FIG. 2 is a side view of the blower illustrated in FIG. 1, illustrating the blower at a zero inclination.
Figure 3:
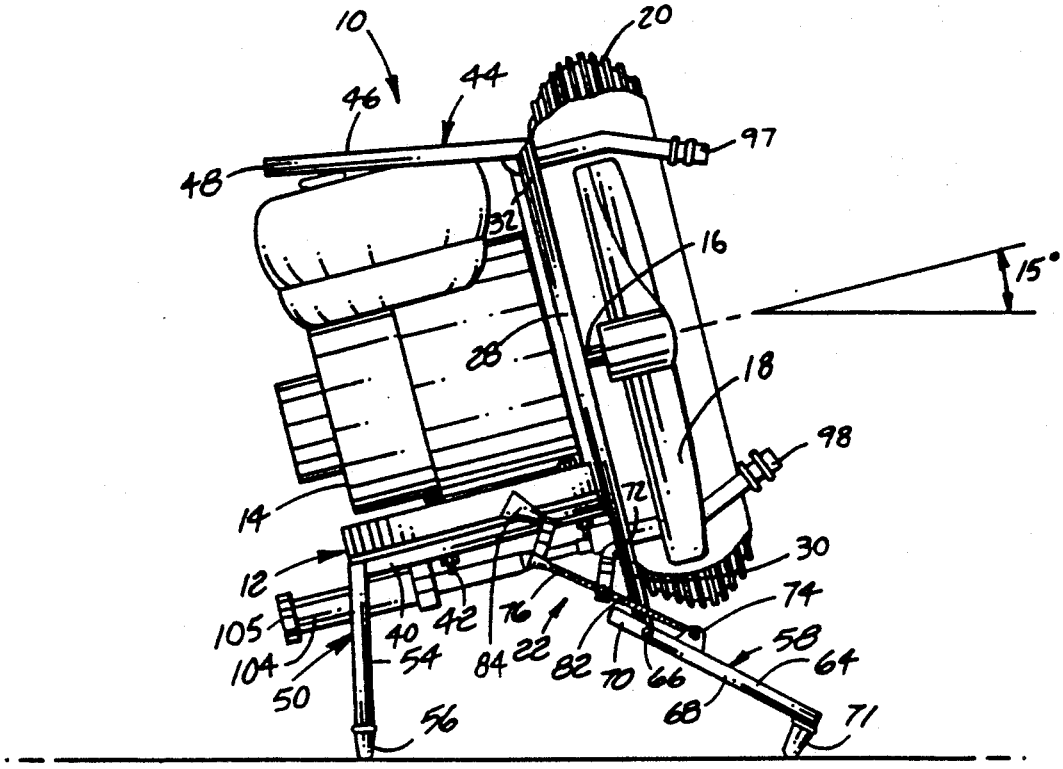
FIG. 3 is a side elevation view similar to FIG. 2, except showing the blower at a fifteen degree inclination and the orientation of the front legs.

Referring now in detail to the drawings, there is illustrated in FIG. 1, a hand-portable fire fighting, positive pressure blower generally designated with the numeral 10 for creating and directing a high velocity stream of air and water mist into a smoke filled space of a burning structure.

The blower 10 includes a portable support frame similar to that disclosed in U.S. Pat. No. 4,906,164, and which is generally designated with the numeral 12 for supporting an internal combustion engine 14 thereon. The internal combustion engine 14 has a substantially horizontally drive shaft 16. A propeller 18 is mounted on the drive shaft for rotating in a plane "P" with the drive shaft on a drive shaft axis "X" to generate an airstream "A" (FIGS. 6, 7) of high velocity that is directed from the outside of a smoke filled space and for driving or displacing the smoke from the space.

Figure 5:
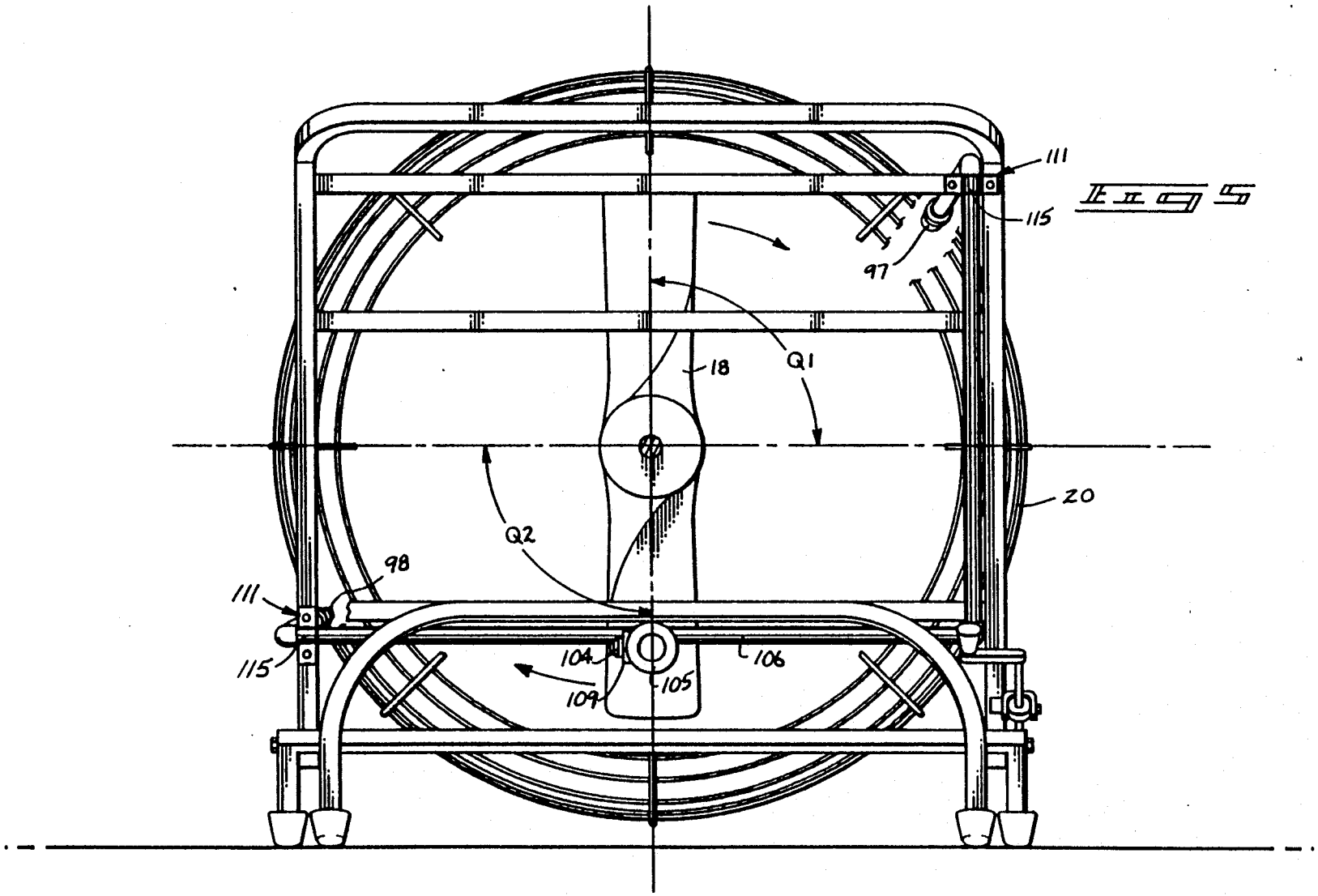
FIG. 5 is a fragmentary rear elevation view showing features of the present water misting system, again with the engine being removed for clarity.
Figure 6:
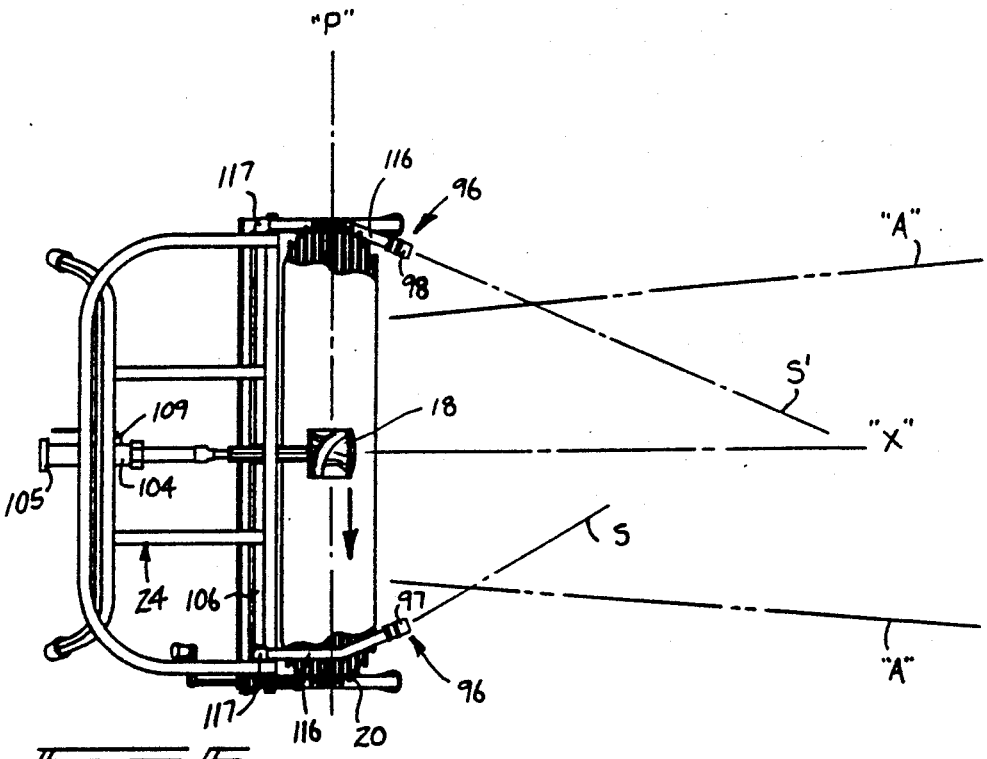

The blower frame 12 includes a propeller guard 20 mounted about the propeller to prevent a fire fighter from being injured from the rotating propeller. The guard 20 extends to a maximum lateral outer edge of the frame 12 as shown in FIG. 5.

The portable support frame 12 also includes a central frame section 24 rearward of the propeller guard 20. Central frame section 24 includes a left upright pillar frame element 26 and a right upright pillar frame element 28 that extend upward between the internal combustion engine 14 and the propeller 18. Each of the frame elements 26 and 28 extend from lower ends 30 to upper ends 32. The central frame section 24 includes transverse or cross brace elements 34 and 36 that extend substantially parallel with each rigidly interconnecting the pillar frame elements 26 and 28. The transverse brace elements 34, 36 extend transversely between the internal combustion engine 14 and the propeller 18.

The central frame section 24 includes engine mount frame elements 40 that extend rearward from the cross brace element 36. The internal combustion engine 14 is mounted to the engine mount frame elements 40 by engine mount bolts 42.

The central frame section 24 further includes a handle frame element 44. Element 44 is substantially U-shaped with side rail sections 46 that are affixed to the upper ends 32 of the pillar frame elements 26 and 28, respectively. Rail sections 46 extend rearwardly along opposite sides of the engine to a central rear rail 48.

Portable support frame 12 further includes a rear leg frame section 50 that is preferably formed as a unitary U-shaped part. It includes a horizontal portion 52 and rear legs 54. The legs extend downward and rearward at an inclined angle with respect to the central frame section 24. Rubber feet or mounts 56 are mounted to the lower end of the rear legs 54 for engaging a substantially horizontal surface.

The portable support frame 12 further includes a tilting mechanism 22 for tilting the engine and propeller 18 to adjust the angle of the airstream "A". It includes a front leg frame section generally designated with the numeral 58. The front leg section is preferably formed of a unitary U-shaped frame part consisting of a cross frame element 60, a left front leg 62 and a right front leg 64. Element 60 and legs 62, 64 extend forward from the cross element 60.

The front leg frame section 58 is pivotally mounted to the lower ends 30 of the pillar frame elements 26 and 28 respectively at pivot locations 66. The cross frame elements 60 are not directly connected to the central frame section 24. The cross frame element 60 serves as a vibrational dampening frame element for materially dampening the vibration caused by the internal combustion engine 14 and the propeller 18.

Each of the front legs 62 and 64 has a forward portion 68 that extends from the pivot point 66 to a forward end supported on rubber feet or pads 71. Additionally, each of the front legs 62 and 64 has a rearward portion 70 that extends rearward from the pivot 66 to the cross frame element 60. Consequently, the forward portion 68 pivots up and down about the pivot 66 to raise and lower the front end of the blower 10.

The tilting mechanism 22 includes a screw bracket 72 welded to a lower end 30 of one of the upright pillar frame elements 26, 28. The tilting mechanism 22 also includes a screw bracket 74 welded to a forward portion 68 of one of the front legs 62, 64.

A screw assembly 76 is operatively interconnected between the screw brackets 72 and 74. The screw assembly 76 includes a screw bearing rotatably mounted at the screw bracket 72 and a screw bearing mounted at the screw bracket 74. The screw bearings receive a lead screw 82 for providing an infinite adjustment of the distance between the screw brackets 72 and 74 about the pivot axis 66 to provide an variable angle adjustment for the propeller axis "X". A crank 84 is mounted to the screw 82 for manually turning the screw 82 to adjust inclination of the propeller axis "X".

The rubber feet or pads 56 and 71 are formed of soft rubber material to assist in absoring vibration and to provide good frictional contact between the legs of the blower and the horizontal surface. It has been found that the unit will stay stationary even though the engine is operated at its maximum speed. Thus a fire fighter is not required to stand at the unit to hold the unit in place during operation.

The propeller 18 is preferably constructed of wood, with two opposing blades 86 and 88 that extend radially outward on opposite sides of a hub 90. The hub 90 is mounted on the shaft 16 by direct connection. The propeller thus rotates in the plane "P" that is perpendicular to the propeller axis "X".

It should be noted the propeller is not confined by a shroud. The wooden propeller 18 with the two oppositely directed blades provides a sufficiently confined airstream "A", centered on the propeller axis that is very directional in nature. Many of the prior art devices utilize a shroud about the propeller with multiple fan blades in an attempt to confine and direct air toward the opening of the smoke filled space. The arrangement shown herein does not require such a shroud, and the airstream "A" has been found to remain consistent about the propeller axis.

The propeller guard 20 is mounted to the frame and extends about the propeller 18 utilizing guard mounting clamps 92 that are illustrated in FIG. 1.

An important aspect of the present invention is the provision of at least one misting nozzle 96 for directing a misted spray of water angularly in the forward direction of travel (with respect to the air flow in the airstream "A") and into the airstream "A" from a position radially outward thereof. In the preferred embodiment, two nozzles: a first nozzle 97 and a second nozzle 98, are provided for directing water mists into the airstream. The preferred nozzles are atomizing nozzles, selected for operation within a pressure range between approximately 40 psi and 150 psi. The nozzles are also selected to deliver water at the selected pressure within a range of approximately between 0.60 gallons per minute and 1.60 gallons per minute in a misted state. The two nozzles are selected of different styles within the above operational ranges according to placement on the blower in order to maximize cooling of the airstream and yet maintain a uniform misted condition therein.

Figure 8:
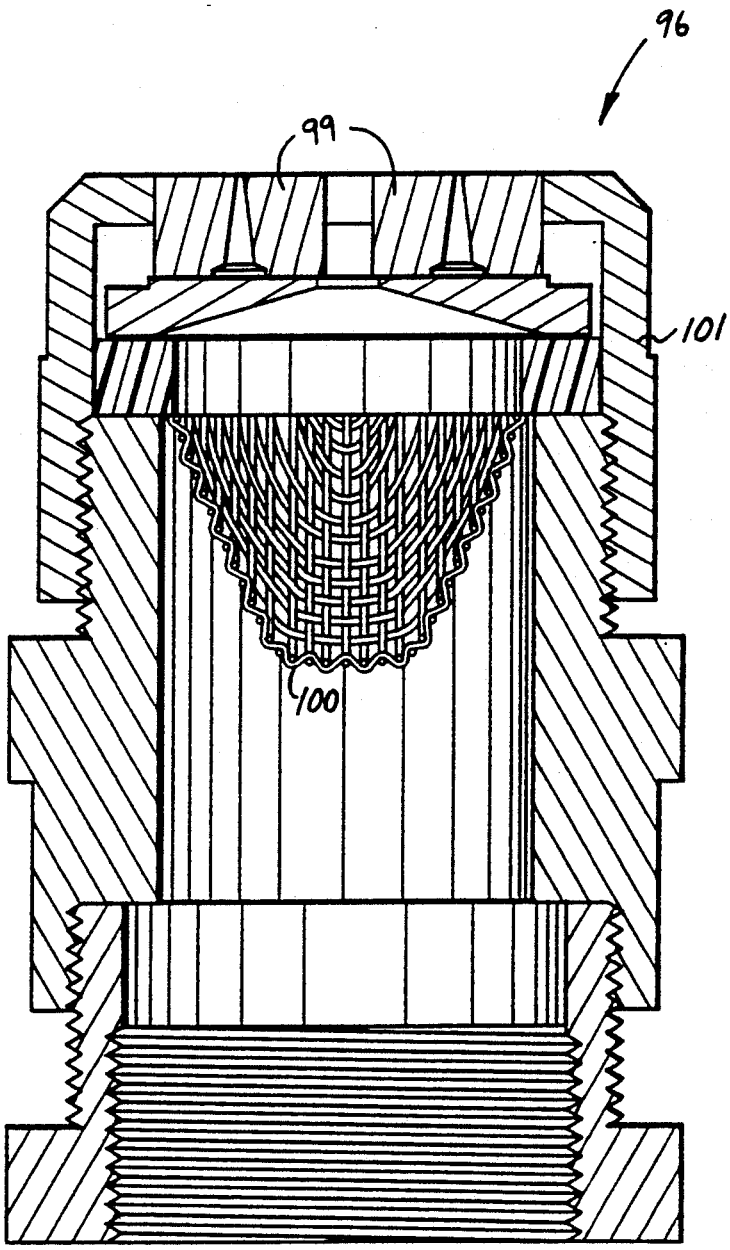
FIG. 8 is an enlarged sectional view through a spray nozzle.

A single typical nozzle 97 or 98 is shown in FIG. 8. As shown, the nozzle includes a nozzle body 101 enclosing a removable basket screen filter 100. The body 101 also supports one or more orifice inserts 99. Each orifice size is selected to meet the above criteria of delivering misted water at an operating pressure between approximately 40 psi and 150 psi and at a delivery rate between approximately 0.30 and 0.80 gallons of water per minute. The mist is delivered in a cone along a spray axis.

Figure 6:
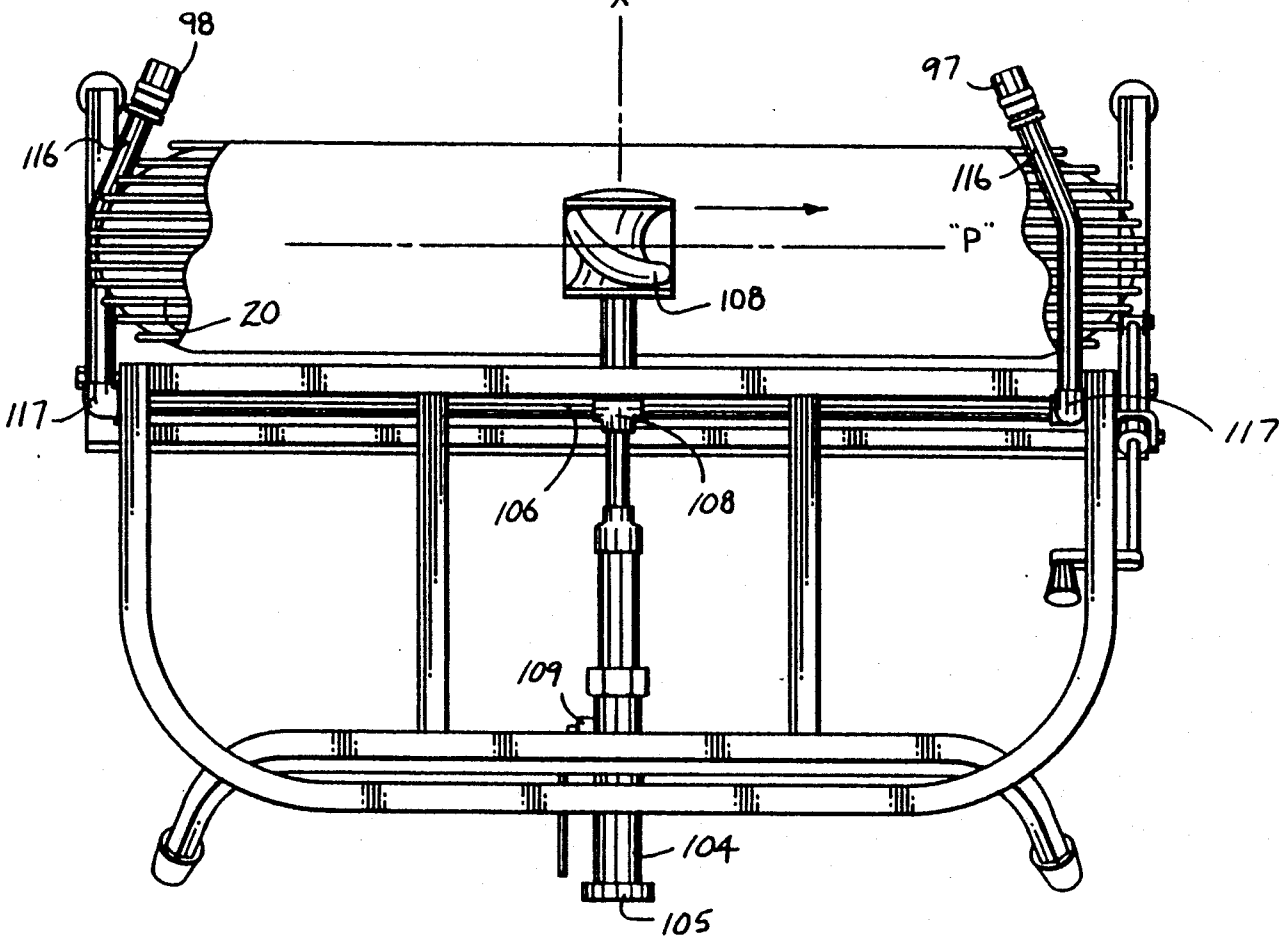
FIG. 6 is a diagrammatic top plan view illustrating the angular relationship of spray patterns to the perimeter, axis and direction of rotation of the propeller and consequent airstream.
Figure 7:
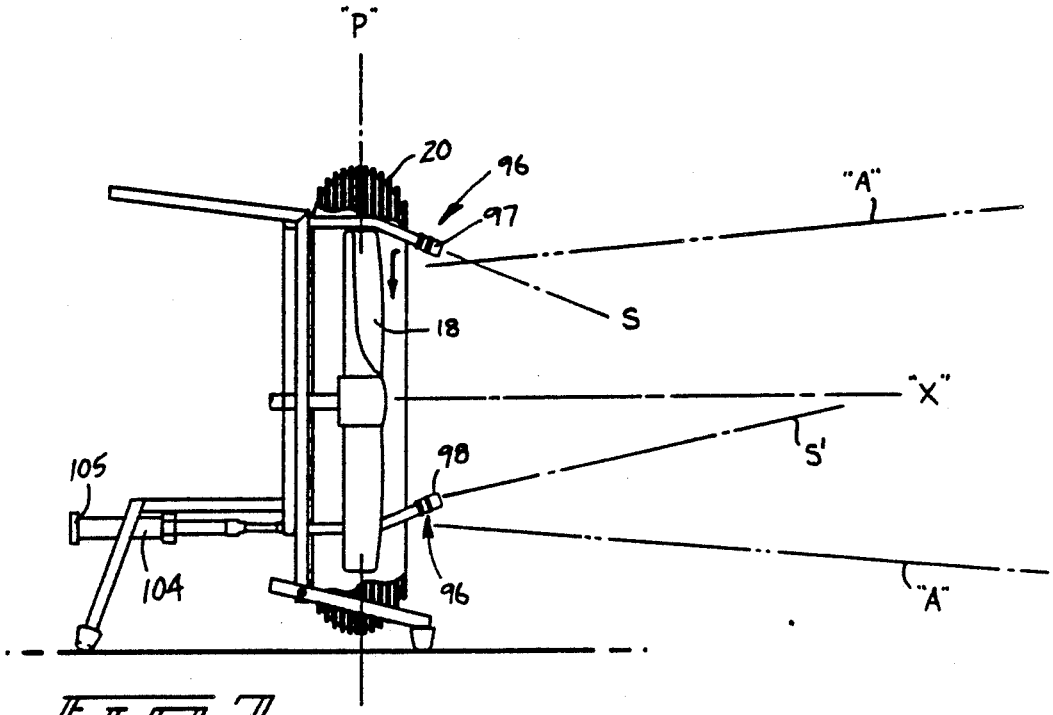
FIG. 7 is a diagrammatic side view primarily illustrating the angular relationship of the spray patterns to the axis and direction of rotation of the propeller and airstream therefrom.

It is important to note the angular relationship of the spray axes "S", "S'" to the rotational axis "X" of the propeller (FIGS. 6, 7). It is also important to note the position of the spray nozzles in relation to the plane "P" of the propeller 18.

Firstly, the spray nozzles 97, 98 are oriented such that the spray axes "S", "S'" are directed in the forward direction of the airstream and angularly inward toward the propeller axis "X". This direction is dictated by the positions of the nozzles which are (a) radially outward of the airstream "A" and propeller, and from a point along the propeller axis "X" forward of the propeller plane "P". Thus, spray patterns from the nozzles are initiated from outside of the airstream and are directed inward into the airstream downstream of the propeller axis "X".

It is significant in that with the above relationship of the nozzles to the propeller axis "X" and the plane "P", that the spray and the droplet size controlled by the nozzles will remain consistent in the airstream during operation of the blower. The droplets do not come into contact with the blades of the propeller and cannot be thrown out of the airstream by the blades. Rather, the mist from the nozzles is injected downstream of the plane "P" of the propeller 18 and is thus taken up by the airstream and moves along with the airstream in substantially the same condition in which the water is emitted from the nozzles. Thus, a consistent moisture content is experienced within the airstream such that the selected droplet size will be substantially maintained and the water particles will not easily drop or be thrown by centrifugal force from the airstream to the adjacent ground surface.

It is preferred that the nozzles also be oriented in particular angular relationships with respect to the direction of rotation for the propeller. Thus, the first nozzle 97 is situated toward the top of the device (in relation to the ground or support surface) and adjacent a quadrant Q1 (FIG. 5) of the rotational path of the propeller where the propeller ends have begun their downward movement. The spray is there directed so its spray axis "S" will cross above the propeller axis and is oriented in the forward direction of air travel.

It is known that the airstream leaving a propeller as described herein has a substantially helical or spiral component in which currents travel forward but in somewhat of the form of a vortex centered substantially along the axis of the propeller. Thus, the water mist from the top or first nozzle 97 is directed in the forward direction of the airstream and with the rotational direction so that the water droplets from the nozzle 97 substantially merge with the airstream.

The second nozzle 98 is substantially diametrically opposed across the propeller axis "X" from the first nozzle 97. The second nozzle 98 is therefore situated toward the bottom of the frame and slightly to one lateral side of the propeller axis "X" and in the rotational quadrant Q2 (FIG. 5) where the propeller ends are below the axis and are starting their upward movement. The second nozzle 98 is held to emit mist along its spray axis "S'" in the forward direction from below and toward the propeller axis. However, as shown in FIGS. 6 and 7, the angle of nozzle 98 is less or shallower than that of the first nozzle 97, so the mist enters the airstream and crosses below the axis "X" downstream of the point where the mist from the first nozzle 97 enters the airstream and crosses above the axis "X". Water mist emitted from the second nozzle 98 will confront the airstream as it is moving forward and upwardly. The directional inertia of the droplets will carry the droplets into the body of the airstream in order to substantially saturate the airstream with the water mist.

It is preferred that the nozzles 97, 98 be selected with the second nozzle 98 of slightly greater capacity than the first 97. This is done so the second nozzle 98 will emit somewhat more water in the form of mist than the top or first nozzle 97. It has been found that this arrangement works best to produce the most desirable air-mist mixture in the airstream "A".

It is noted that the nozzles 97, 98 are positioned radially outward of the airstream but within the horizontal and vertical limits of the frame edge or perimeter defined by the propeller guard 20 portion of the frame 12. Thus, the nozzles are situated within the framework and are protected by the frame. Furthermore, the nozzles do not project outwardly of the framework to present an obstruction or enlarge the overall size of the complete unit.

It has been found that the spray nozzles 97, 98 mounted in the above configuration produce a uniformly misted airstream. The water particles within the airstream form a vapor and a mist or fog which include several advantages. Firstly, cooling of the airstream is maximized by the uniformly sized droplets. The cool, moist air diminishes the intense heat of a fire, significantly reduces water damage, ventilates smoke and particles of combustion simultaneously, serves to rehabilitate fire personnel and introduces a layer of cool air between smoke and victims. Secondly the water particles are evenly dispersed in the airstream "A" and are carried over substantial distances without precipitating out and onto the ground. In most instances the water contained in the airstream will carry into and beyond a fire. This facilitates cleaning of the atmosphere adjacent the fire as the smoke and small particles of combustion attach to the water particles and are carried by the airstream away from the involved area. The area is thus cooled by the cool, moist air, and is well ventilated for better breathing and visibility.

The nozzles 97, 98 are connected to a supply conduit as shown at 104 (FIG. 4, 5) for connecting the misting nozzles 97, 98, to a source of water (not shown) preferably under pressure as from a fire hydrant or pump truck. While the above water sources may be preferred, it may be understood that the operating pressures indicated above do not exclude the use of ordinary household water pressure as a source of supply. In other words, the present nozzles 97 and 98 could effectively be connected to a common garden hose operating at standard household water pressure of 40 to 60 psi.

The supply conduit 104 includes a water supply fitting 105. The water supply fitting 105 is standard for hose type couplings and is substantially centered on a delivery manifold 106. The supply fitting 105 is centrally located in order to equalize the water pressure between the nozzles 97, 98.

The manifold 106 includes several progressively reduced sections 107. Internal diameters of sections diminish from the fitting 105 to the nozzles 97, 98 to effectively maintain constant water pressure at the nozzles 97, 98.

A shutoff valve 109 is provided along the supply conduit 104. The shutoff valve 109 is preferably downstream of the water supply fitting 105 and upstream of the central "T" 108. The valve 109 may be selectively manually operated to turn the spray from nozzles 97, 98 off and on.

The misting nozzles 97 and 98 may be supplied with the blower and constructed with the blower unit for sale and use therewith. The nozzles may also be retrofitted to existing powered ventilators not previously supplied with the misting features. In either instance, the nozzles may be mounted to the frame by a bracket means 111. Bracket means 111 is provided to mount the conduit 104 and nozzles 97, 98 to the frame such that the nozzles are situated radially outward of the propeller and the airstream and with the nozzles oriented in the relation to the airstream to direct a misted spray angularly in said forward direction and into the airstream. Bracket means 111 is comprised of a series of mounting brackets 115 that secure the supply conduit 104 to the frame. The bracket means 111 may also be incorporated in portions of the supply conduit in the form of bent pipe sections 116 and adjustable pipe fittings 117 that selectively permit angular positioning of the nozzles 97, 98.

It should be noted that the water supply fitting 105 is not only centered on the frame but is also situated below the propeller axis "X" and above the ground or other support surface. This relationship is provided to make use of the connecting hose to further stabilize the unit when in use. The weight of the hose, when connected to the fitting, has a substantial stabilizing effect on the unit regardless of the selected angular position of the airstream being emitted therefrom. The hose is attached at a low profile position where it is less likely to be run into or tripped over by fire fighters.

The unit described above is operated in a simple and efficient manner without requiring the presence of an attendant during operation. The unit may be set up as desired, usually about 10 feet in front of an opening such as a doorway or window of the involved structure. This may be done by a single individual. The same individual can start the engine and turn on the valve 109 to begin operation. The unit may then be left to perform its function until the fire is put out. Then, the user may simply go to the device, turn off the valve 109, and shut the engine down. The device may then be disconnected from the water supply source (of course following shutting of the main value). The entire unit can then be moved to a proper storage facility within a pump truck or other appropriate transport vehicle.

Several advantages become apparent from use of the present misting arrangement over other known forms of misting ventilators. Firstly, the water supply is substantially lower in gallons per minute requirement due to the predictable, consistent misting qualities developed by introducing water in misted form from nozzle positions radially outward of the airstream. The water mists enter the airstream and are carried by the airstream substantially as they are emitted from the spray nozzles.

With the nozzle size and positions discussed above, the particles of water permeate the airstream and provide a uniform, very significant cooling effect on the ambient air temperature within the airstream. This has an extremely beneficial effect in reducing the temperature at the source of heat. The fire fighters are afforded significantly more comfort in their attack on the blaze, while visibility is substantially increased as smoke and particles of combustion attach themselves to the water droplets and are carried in the airstream away from the blaze.

Further, the misted airstream includes predictable sized water droplets that will be carried, due to the selected droplet size, in the airstream and through the structure. Due to the structure described above, the droplets will not easily precipitate out of the airstream and drop to the ground surface along the way to the source of the fire. Thus, the water is used to its maximum advantage.

A still further advantage from the above arrangements has been realized in a unique process made possible by the present device for detecting "hot spots". The misted airstream from the present unit has been directed against wall surfaces behind which a source of intense heat is suspected. If there is such a "hot spot" along the wall surface, the water particles within the airstream that come into contact with the wall surface will vaporize and emit as visible steam from the "hot spot". Thus, the fire fighters are afforded the advantage of being able to pinpoint particular "hot spot" areas without risking their safety and while effectively cooling the area.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A hand-portable fire fighting, positive pressure ventilation and water misting blower for generating and directing a focused water ladened airstream for use in fighting fires and smoke in a structure, using positive pressure ventilation techniques, comprising:

a portable support frame;

an engine mounted on the frame for rotating a propeller drive shaft on a propeller shaft axis in a prescribed direction of rotation;

a propeller having blades, operatively connected to the propeller drive shaft for directing air in an airstream along the propeller shaft axis in a forward direction in the general form of a helix such that the airstream has a forward directional component and a rotational direction about the propeller axis;

a propeller guard mounted on the frame surrounding the propeller;

at least one misting nozzle operatively stationarily mounted to the frame radially outward of the propeller and directed forward and radially inward toward the propeller axis for directing a misted spray of water angularly forward and radially inward into the airstream to cool the airstream and enable the airstream to carry the water mist into the structure; and a supply conduit mounted to the misting nozzle and including a water supply fitting for connecting the misting nozzle to a source of water.

2. The hand-portable fire fighting, positive pressure ventilation and water misting blower as defined in claim 1 wherein the propeller rotates in a prescribed plane and wherein the misting nozzle is oriented on the frame forward of the prescribed plane in relation to the forward direction to spray a mist of water forward and radially inward into the airstream.

3. The hand-portable fire fighting, positive pressure ventilation and water misting blower as defined in claim 1 wherein the misting nozzle is oriented on the frame to spray a mist of water into the airstream on an axis oriented angularly toward the propeller axis and in a lower quadrant of rotation of the propeller in which the blade is rotating upwardly.

4. The hand-portable fire fighting, positive pressure ventilation and water misting blower as defined in claim 1 wherein the misting nozzle is oriented on the frame to spray a mist of water into the airstream on an axis oriented angularly toward the propeller axis and in an upper quadrant of rotation of the propeller in which the blade is rotating downwardly.

5. The hand-portable fire fighting, positive pressure ventilation and water misting blower as defined in claim 1 wherein there are two misting nozzles on the frame, including:

a first misting nozzle on the frame to spray a mist of water into the airstream on an axis oriented angularly toward the propeller axis and in an upper quadrant of rotation of the propeller in which the blade is rotating downwardly; and a second misting nozzle on the frame to spray a mist of water into the airstream on an axis oriented angularly toward the propeller axis and in a lower quadrant of rotation of the propeller in which the blade is rotating upwardly.

6. The hand-portable fire fighting, positive pressure ventilation and water misting blower as defined in claim 1 wherein there are two misting nozzles on the frame, including:

a first misting nozzle is oriented on the frame to spray a mist of water into the airstream on an axis oriented angularly toward the propeller axis and to cross above the axis of rotation of the propeller;

a second misting nozzle is oriented on the frame to spray a mist of water into the airstream on an axis oriented angularly toward the propeller axis and to cross below the axis of rotation of the propeller;

wherein the first and second misting nozzles are situated substantially diametrically opposite one another in relation to the propeller axis.

7. The hand-portable fire fighting, positive pressure ventilation and water misting blower as defined in claim 1 wherein the frame extends about an external lateral perimeter and wherein there are two misting nozzles positioned within the perimeter of the frame and radially outside the airstream.

8. The hand-portable fire fighting, positive pressure ventilation and water misting blower as defined in claim 1 wherein there are two misting nozzles on the frame, including:

a first misting nozzle oriented on the frame to spray a mist of water into the airstream on an axis oriented angularly forward and radially inward toward the propeller axis;

a second misting nozzle oriented on the frame to spray a mist of water into the airstream on an axis oriented angularly forward and radially inward toward the propeller axis at an angle to the propeller axis less than the angle of the axis of the first misting nozzle; and wherein the first and second misting nozzles are situated substantially diametrically opposite one another in relation to the propeller axis.

9. The hand-portable fire fighting, positive pressure ventilation and water misting blower as defined in claim 1 wherein there are two misting nozzles on the frame, including a first misting nozzle on the frame and a second misting nozzle on the frame;

wherein the first and second misting nozzles are situated substantially diametrically opposite one another in relation to the propeller axis; and wherein the supply conduit includes a manifold connecting the first and second nozzles and wherein the water supply fitting for connecting the misting nozzle to a source of water is centered on the manifold between the first and second nozzles.

10. The hand-portable fire fighting, positive pressure ventilation and water misting blower as defined in claim 1 wherein there are two misting nozzles on the frame;

wherein the misting nozzles are situated substantially diametrically opposite one another in relation to the propeller axis;

wherein the supply conduit includes a manifold connecting the first and second nozzles and wherein the water supply fitting for connecting the misting nozzle to a source of water is centered on the manifold between the nozzles; and wherein the supply conduit, including the manifold is comprised of pipe and wherein the pipe diameter is progressively reduced from the water supply fitting to the nozzles.

11. The hand-portable fire fighting, positive pressure ventilation and water misting blower as defined in claim 1:

wherein the frame is oriented to support the engine and propeller shaft above a support surface; and wherein the supply conduit includes a manifold connecting the misting nozzle and wherein the water supply fitting for connecting the misting nozzle to a source of water is situated below the propeller axis and above the support surface.

12. The hand-portable fire fighting, positive pressure ventilation and water misting blower as defined in claim 1 wherein the misting nozzle is provided to deliver approximately 0.60 to 1.60 gallons of water per minute at an operating pressure of approximately 40 to 150 pounds per square inch.

13. The hand-portable fire fighting, positive pressure ventilation and water misting blower as defined in claim 1 wherein there are two misting nozzles provided to deliver approximately 0.60 to 1.60 gallons of water per minute at an operating pressure of approximately 40 to 150 pounds per square inch.

14. The hand-portable fire fighting, positive pressure ventilation and water misting blower as defined in claim 1 wherein there are two misting nozzles provided to deliver approximately 0.60 to 1.60 gallons of water per minute and wherein one of the nozzles is of smaller capacity than the other.

15. A water misting attachment for a hand-portable fire fighting, positive pressure ventilation blower including a portable support frame, an engine mounted on the frame for rotating a propeller drive shaft on a propeller shaft axis in a prescribed direction of rotation, a propeller operatively connected to the propeller drive shaft for directing air in an airstream along the propeller shaft axis in a forward direction in the general form of a helix such that the airstream has a forward directional component and a rotational direction about the propeller axis, and a propeller guard mounted on the frame surrounding the propeller; wherein the attachment is comprised of:

at least one misting nozzle;

a supply conduit mounted to the misting nozzle and including a water supply fitting for connecting the misting nozzle to a source of water;

bracket means for operatively mounting the supply conduit and nozzle to the frame with the nozzle positioned radially outward of the propeller and airstream and oriented in relation to the airstream to direct a misted spray of water angularly forward and radially inward toward the propeller axis and into the airstream.

16. The attachment of claim 15 wherein the bracket means and supply conduit are oriented to position the misting nozzle on the frame to spray a mist of water into the airstream on an axis oriented angularly toward the propeller axis and from within a quadrant of rotation of the propeller in which a blade end thereof is rotating downwardly.

17. The attachment of claim 15 wherein the bracket means and supply conduit are oriented to position the misting nozzle on the frame to spray a mist of water into the airstream on an axis oriented angularly toward the propeller axis and from within a quadrant of rotation of the propeller in which a blade end thereof is rotating upwardly.

18. The attachment of claim 15 wherein there are two nozzles and wherein the supply conduit and bracket means are arranged to position the nozzles at approximately diametrically opposed positions in relation to the propeller axis.

19. The attachment of claim 15 wherein there are two misting nozzles;

wherein the supply conduit includes a manifold connecting the nozzles and wherein the water supply fitting for connecting the misting nozzles to a source of water is centered on the manifold between the nozzles.

20. The attachment of claim 15 wherein the supply conduit, including the manifold is comprised of pipe and wherein the pipe diameter is progressively reduced from the water supply fitting to the nozzles.

21. The attachment of claim 15 wherein a shutoff valve is positioned in the water supply conduit between the supply fitting and the nozzle.

22. The attachment of claim 15 wherein the misting nozzle is provided to deliver approximately 0.60 to 1.60 gallons of water per minute at an operating pressure of approximately 40 to 150 pounds per square inch.

23. The attachment of claim 15 wherein there are two misting nozzles provided to deliver approximately 0.60 to 1.60 gallons of water per minute at an operating pressure of approximately 40 to 150 pounds per square inch.

24. The attachment of claim 15 wherein there are two misting nozzles provided to deliver approximately 0.60 to 1.60 gallons of water per minute and wherein one of the nozzles is of smaller capacity than the other.

25. The attachment of claim 15 wherein there are two misting nozzles;

wherein the supply conduit includes a manifold connecting the nozzles and wherein the water supply fitting for connecting the misting nozzles to a source of water is centered on the manifold between the nozzles;

wherein the supply conduit and bracket means are arranged to position the nozzles at approximately diametrically opposed positions in relation to the propeller axis; and wherein the supply conduit, including the manifold is comprised of pipe and wherein the pipe diameter is progressively reduced from the water supply fitting to the nozzles.

* * * * *